United States Patent [19]

Ganz et al.

[11] 4,367,954

[45] Jan. 11, 1983

[54] DEVELOPING DEVICE FOR COPIER

[75] Inventors: Alfred Ganz, Gröbenzell; Karl Hartwig, Unterhaching; Christoph Jung, Munich; Günther Schnall, Eching; Erich Schlick, Unterschleissheim; Jürgen Vossnacke, Hohenschäftlarn, all of Fed. Rep. of Germany

[73] Assignee: Baldwin Piano & Organ Company, Cincinnati, Ohio

[21] Appl. No.: 223,722

[22] Filed: Jan. 9, 1981

[30] Foreign Application Priority Data

Mar. 20, 1980 [DE] Fed. Rep. of Germany ..... 3010647

[51] Int. Cl.[3] ..... B01F 15/02

[52] U.S. Cl. ..... 366/156; 118/612; 222/230; 366/337

[58] Field of Search ..... 366/336, 337, 338, 339, 366/155, 156; 118/657, 658, 612; 222/230, 228, 229; 355/3 DD

[56] References Cited

U.S. PATENT DOCUMENTS

| | | | |
|---|---|---|---|
| 2,901,988 | 9/1959 | Hepburn | 366/156 |
| 3,140,861 | 7/1964 | Krup | 366/156 |
| 3,697,050 | 10/1972 | Stanley | 118/658 |
| 3,930,466 | 1/1976 | Stover | 118/658 |
| 4,075,977 | 2/1978 | Williams | 118/658 |
| 4,235,193 | 11/1980 | Groen | 118/658 |
| 4,261,290 | 4/1981 | Yamashita | 366/336 |

*Primary Examiner*—Robert W. Jenkins
*Attorney, Agent, or Firm*—Frost & Jacobs

[57] ABSTRACT

A developer device for electrostatic copiers includes a housing in which toner is circulated. The circulating toner is dropped in free fall at a predetermined location. Underneath that location are two side-by-side lengthwise extending channels into which the falling toner is substantially uniformly distributed. Guide baffles in one channel direct the incoming toner along the channel in one direction, and guide baffles in the other channel direct toner in the opposite direction.

8 Claims, 3 Drawing Figures

DEVELOPING DEVICE FOR COPIER

BACKGROUND OF THE INVENTION

This invention relates to electrostatic copiers in general, and to a developing device for such copiers in particular.

Electrostatic copiers operate on the principle of forming on a surface of an image carrier a latent image—composed of electric charges—of an original to be copied. Thereafter, the latent image is "developed" by adhering toner particles to the charged portions of this latent image to form a visible image, which is then transferred to and fixed as a copy carrier, e.g., a sheet of copy paper. This is a simplified explanation, but it suffices to point out the need for the presence of a developing device in such copiers. It is these developing devices which furnish and meter the required toner.

Devices of this type are known which have a toner-feeding spiral whose purpose it is to feed toner and to discharge it over a relatively small area. These devices are usually employed for returning into circulation such quantities of residual toner as have been recovered in a cleaning station. However—and this will be more fully explained later herein—such devices are also suitable for furnishing (feeding) toner from a supply bottle that can be connected to the copying machine.

A problem, resulting from the small toner discharge area of these devices, is the difficulty which is experienced in mixing-together of the toner. One proposal for a remedy has been made in German Published Application No. 2,551,985. This described a relatively complicated cross-mixer which causes forced mixing of the toner-carrier particle mixture. Due, however, to this forced mixing a high rate of toner-carrier mixture wear is experienced with this equipment, so that the mixture must be frequently replaced for adequate copying results.

A simpler cross-mixer, and one which exerts much less wear on the toner-carrier mixture, is disclosed in German Published Application No. 2,161,835. This equipment is not, however, suitable for the rapid distribution of a toner component that has been admitted into the developing device at a certain location thereof.

SUMMARY OF THE INVENTION

Accordingly, it is a general object of the invention to avoid the drawbacks of the prior art.

A more particular object is to provide a developer device having an improved toner admitting arrangement by means of which added toner can be distributed throughout the developer device in a simple and rapid manner and without wear damage to the toner.

Pursuant to these objects, and still others which will become apparent hereafter, one aspect of the invention resides in a developer device for electrostatic copiers in which toner is circulated during the developing operation, a combination which comprises an elongated housing; means forming two mixing channels extending lengthwise of the housing; means for gravity-discharging toner at a predetermined location in the housing substantially midway of the elongation of the channels; and guide surfaces for the discharged toner arranged in the channels and inclined lengthwise of the same and relative to the direction of gravity discharge of the toner.

The device according to the invention distributes incoming toner in at least substantially equal proportions into the two mixing channels, wherein the toner is then advanced in mutually opposite directions. A simple way of obtaining the desired distribution effect in an especially advantageous manner, is to provide in each of the mixing channels two guide surfaces of which one extends from one end of the channel approximately to the mid-point of the channel, whereas the other extends from a location intermediate the one end and the mid-point to a position beyond the mid-point in direction towards the other channel end. For example, assuming that each channel is composed of four quarters of equal length, one of the guide surfaces may extend from the vicinity of the outermost edge of the first quarter to the vicinity of the juncture between the second and third quarters, whereas the other guide surface may extend from the vicinity of the juncture between the first and second quarters to the vicinity of the juncture between the third and fourth quarters.

It is also advantageous if the wall separating the two channels from one another is provided with further toner-guiding surfaces which guide the toner circulating during operation of the device, only to that portion of the respective mixing channel which has guide surfaces in the region following the toner dispensing area. In a device constructed according to the invention the toner which circulates in the vicinity of one end of the developer apparatus, is transported to the other end of the apparatus within two circulation cycles; this results in very intensive mixing of the toner.

To reduce or eliminate any interference with the free flow of toner in the device, it is advisable for the mixing channels to have a cross-section which increases continuously from the inlet to the outlet of the respective channel.

Toner sometimes tends to "cake" in the developer device and may then block the dispensing opening or otherwise interfere with proper circulation. This can be avoided in accordance with another concept of the invention, according to which the rotating feed helix—which is in form of an open-ended spring—abuts under the influence of its own expansion tendency with one end against a pin projecting into the feed tube in which the spring is accommodated. Once during each revolution of the helix the open end of the same snaps past this pin; this allows a sudden axial expansion of the spring by a distance corresponding to the pitch-height of one turn of the helix and causes sufficient agitation of the toner to prevent caking, or blocking of the dispensing opening. The efficacy of this measure can be further improved by having the pitch angle of the helix increase in direction towards the dispensing opening.

A portion of the feed tube in which the helix rotates, may extend out of the housing of the device and the tube may be turnable through about 180° about its longitudinal axis. A toner supply bottle may be threadedly connected to this portion, so that its elongation is normal to the longitudinal axis of the tube. In this manner the open toner bottle can be secured to the tube with its open end facing upwardly (i.e. so that no toner can spill while the connection is being made), and thereafter the tube with the bottle is turned until the open end of the bottle faces vertically, or more or less vertically, downwardly so that toner can run into the tube for transportation by the helix.

The novel features which are considered as characteristic for the invention are set forth in particular in the appended claims. The invention itself, however, both as to its construction and its method of operation, together with additional objects and advantages thereof, will be best understood from the following description of specific embodiments when read in connection with the accompanying drawings.

DESCRIPTION OF THE PREFERRED EMBODIMENTS

Figure 1:
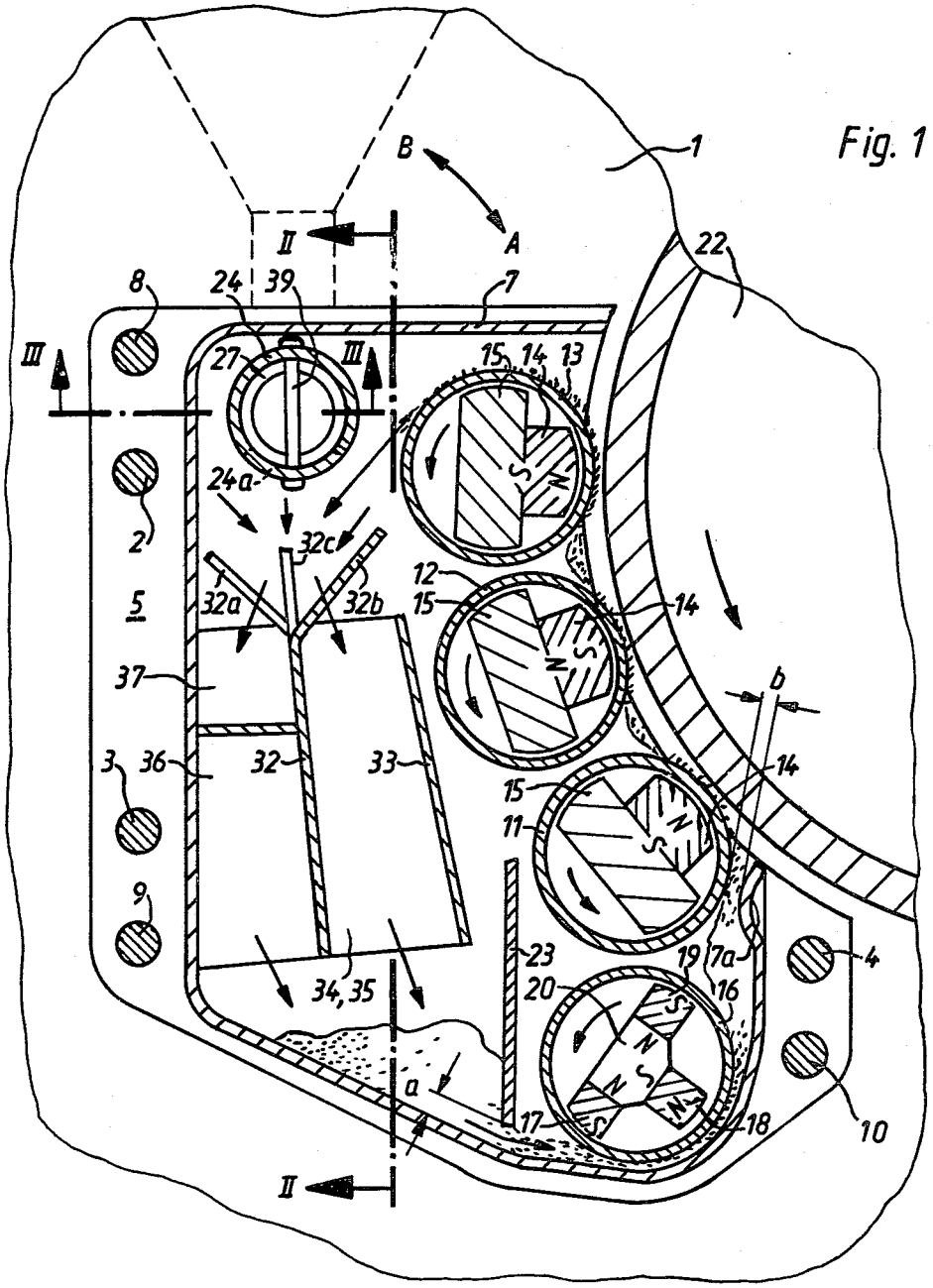
FIG. 1 is a section through an apparatus embodying the invention, taken on line I—I of FIG. 2.
Figure 2:
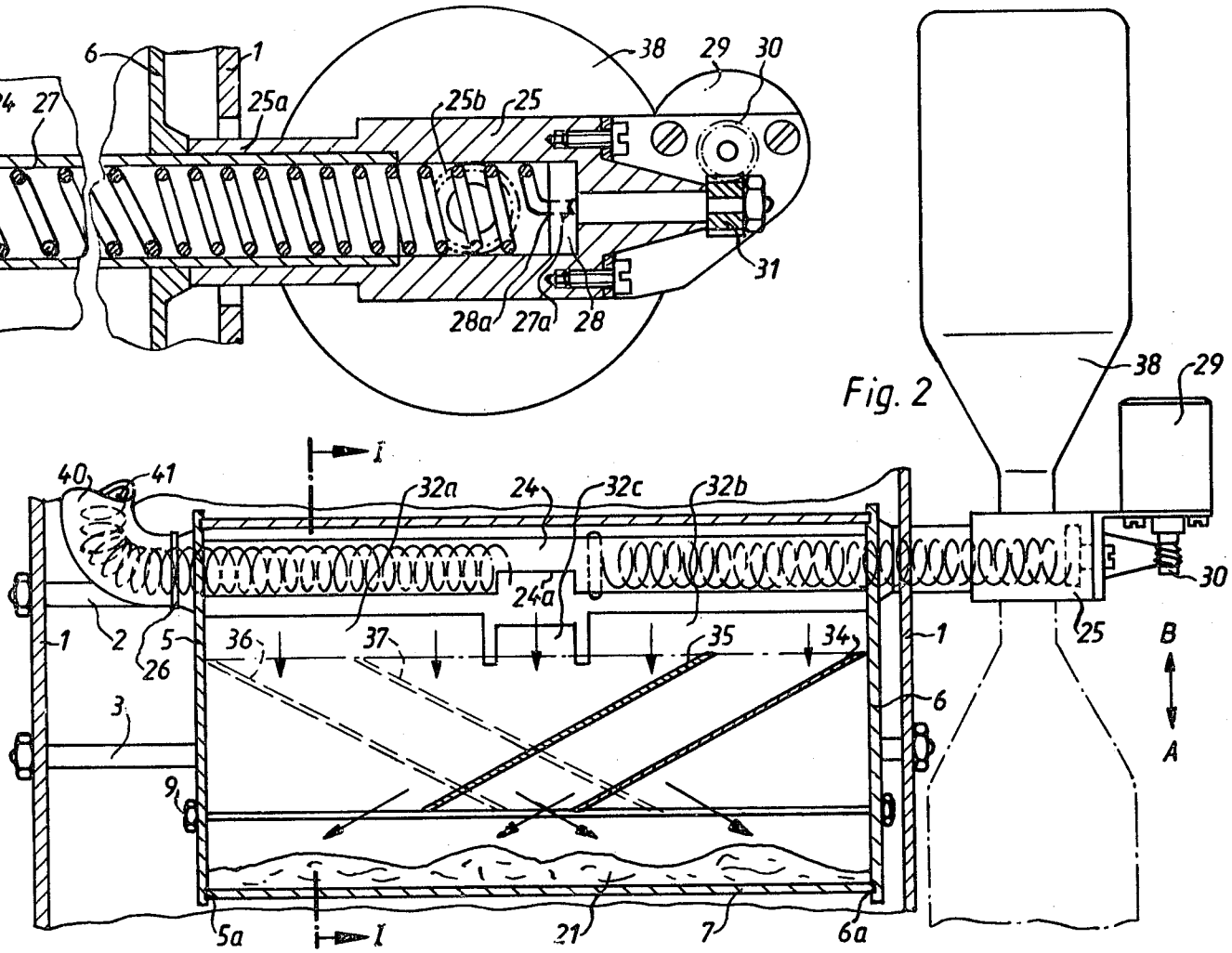
FIG. 2 is a section taken on line II—II of FIG. 1.

The drawing shows in FIGS. 1 and 2 only the housing 1 and the imaging drum 22 of the overall copying machine; this is all that is necessary for an understanding of the relationship of the inventive device with reference to the remainder of the machine. By means of bolts 2, 3 and 4 two end plates 5, 6 for the developer device are mounted on the housing 1. The facing surfaces of end plates have grooves 5*a*, 6*a* (here of endless generally annular configuration) into which the ends of a housing 7 are inserted. Threaded bolts 8, 9 and 10 connect the end plates 5, 6 with the housing 7.

Turnably journalled between the end plates 5, 6 are hollow magnetic transporting cylinders 11, 12 and 13. Each of these cylinders accommodates a permanent magnet 14 which is mounted on a stationary carrier 15. The carriers 15 are of material having high magnetic permeability and are so shaped (and the poles of the magnets 14 are so arranged) that the magnetic flux is directed from one to the next of the cylinders 11–13. The purpose of this is to produce intermediate the cylinders 11–13 a continuous magnetic field which acts to produce a uniform "magnetic brush" effect. An important advantage of this feature is that it prevents the toner particles which are being transported by the cylinders 11–13 from being drawn deep enough into the gaps between the adjacent cylinders to be able to cause a braking effect on the rotation of these cylinders.

A further turnable hollow transporting cylinder 16 is arranged downwardly of the cylinders 11–13. Its interior contains three stationary permanent magnets 17, 18 and 19 which are arranged on a magnetically permeable carrier 20 with their poles in alternating relationship, as shown. The purpose of cylinder 16 is to supply toner from the supply 21 in the lower part of housing 7 to the cylinders 11–13.

The quantity of toner supplied is controlled by a baffle 23 in the lower part of housing 7 where it forms a gap "a" for the inflow of toner; baffle 23 may be adjustable in order for the width of gap "a" to be variable. The thickness of the "magnetic brush" (i.e. toner layer) that develops on the cylinders 11–13 which contact the drum 22, is controlled by the width of a gap "b" formed between the surface of cylinder 11 and a nose or projection 7*a* formed on housing 7 adjacent the cylinder 11, and through which the toner must pass.

Figure 3:
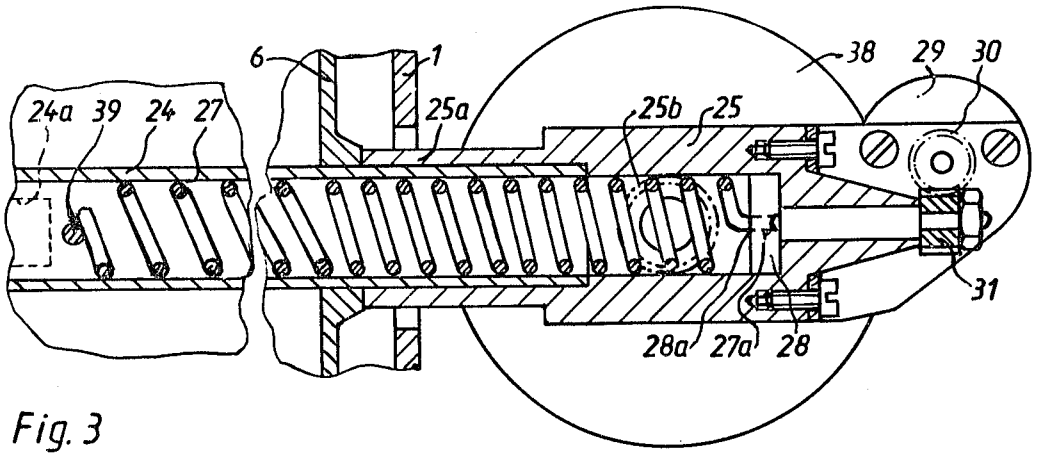
FIG. 3 is an enlarged-scale view, partly sectioned, showing details of the toner transporting mechanism.

A toner feed tube 24 is turnably mounted in the upper part of housing 5–7. At one end the feed tube 24 has an end piece 25 threaded on it (FIG. 3); the tube is held by a portion 25*a* of end piece 25 and by a circlip 26, respectively. A toner-feeding helix in form of a helical spring 27 is turnably received in feed tube 24 and has one end 27*a* which is pushed through a slot 28*a* of a rotatable entraining member 28. The latter is driven by an electric motor 29 via a worm wheel 30 which meshes with a gear 31 on entraining member 28 (FIG. 3).

Also arranged in the housing 5–7, but below the tube 24, is a divider baffle 32 which forms two toner distributing channels with a second baffle 33 and a portion of the wall of housing 7. These receive toner which drops through a dispensing opening 24*a* of tube 24 and also from a portion of the upper cylinder 13 which is located outside the lines of magnetic flux. To assure free developer flow the two channels diverge slightly in downward direction, as shown in FIG. 1.

Arranged in these channels are toner guide baffles 34, 35 and 36, 37 which are so inclined to the direction of movement of the entering toner as to form with the horizontal an angle of at least 28°. This angle of course contributes to the maintenance of free developer flow. The two baffles 34, 35 and 36, 37 in the respective channel both extend in one and the same direction and, as mentioned earlier, one of them extends from the vicinity of one end of the respective channel to the vicinity of the channel mid-point, whereas the other baffle of the same pair extends from the vicinity of the first and second quarter junction to the vicinity of the third and fourth quarter junction. With this arrangement the developer which circulates in the device during use of the copier, is transferred from one end of the device to the other in the course of two circulation cycles. This results in a desirable, very intensive mixing of the developer (i.e. toner and carrier).

It is evident from FIG. 2 that a part of the length of each channel does not have guide baffles in it. It is equally clear that it is undesirable for developer to drop into these parts. To avoid this the baffle 32 is formed with sections 32*a*, 32*b* which cover these respective parts and in each case direct the developer coming from opening 24*a* or from cylinder 13 into the respectively other channel. Another section 32*c* of baffle 32 extends up from the baffle beneath the opening 24*a*; its purpose is to uniformly or substantially uniformly distribute the stream of toner exiting through opening 24*a*, into the two channels.

As mentioned earlier, the tube 24 is provided with an end piece 25. FIG. 3 shows that this has a thread 25*b* to which the threaded neck of a toner supply bottle 38 may be secured. To avoid spillage of toner during removal of the old bottle and/or installation of a new one, the tube 24 and/or the end piece 25 is turnable through about 180° about the longitudinal axis of the tube. It is therefore a simple matter to turn tube 24 and/or end piece 25 in the direction of arrow A (FIG. 1; FIG. 3) until the thread 25*b* faces downwardly so that bottle 38 can be secured to it in upright position, i.e., with its open end facing upwardly (see the broken-line showing in FIG. 2). After the connection is completed the bottle 38 and tube 24 with end piece 25 are turned through about 180° in the direction of arrow B, until bottle 38 assumes the solid-line position in FIG. 2, so that its open end now faces downwardly and toner can flow through it into the interior of pipe 24, for transportation to opening 24*a* by the turning helix 27.

FIG. 3 shows that the (left-hand) free end 27*a* of helix 27 springily engages a pin 39 which projects into the tube 24. This means that each time the helix 27 is turned by the motor 29 via gears 30, 31 the free end 27*a* abruptly snaps forwardly by a distance corresponding to the axial length of one convolution of helix 27; this breaks up any toner agglomerations that may tend to occur in the vicinity of the end 27*a* or of the opening 24.

To enhance this effect and offer still more protection against the formation of agglomerations, the pitch angle of the convolutions of helix 27 is greater in the vicinity of the opening 24 than in the region where the bottle 38 is connected.

A hose 40 is pushed onto or otherwise connected to, that end of the tube 24 which is remote from end piece 25. Another turnable helical spring 41 is accommodated in the hose 40. This arrangement serves, in a manner known per se, for returning toner recovered by a cleaning device, e.g., a doctor blade or the like, into the toner circuit. This toner, also, is supplied via opening 24 into the two mixing channels and rapidly distributed throughout the volume of developer 21 by the baffles 34–37.

The device according to the invention thus achieves its intended purpose, i.e., to rapidly distribute toner throughout the developer apparatus in a simple manner which is not deleterious to the longevity of the developer mix.

While the invention has been illustrated and described as embodied in a developer device for electrostatic copiers, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by Letters Patent is set forth in the appended claims:

1. In a developer device for electrostatic copiers, in which toner is circulated during the developing operation, a combination comprising an elongated housing; means forming two mixing channels extending lengthwise of said housing; means for gravity-discharging toner at a predetermined location in said housing substantially midway of the elongation of said channels; and guide surfaces for the discharged toner arranged in said channels and inclined lengthwise of the same and relative to the direction of gravity discharge of the toner, each of said channels comprising a pair of said guide surfaces which are both inclined in one and the same direction, one guide surface of each pair extending from the region of an outer end of the first quarter of the length of the respective channel to the vicinity of a juncture between the second and third quarters of the length, and the other guide surface of the pair extending from the vicinity of a juncture between the first and second quarters of the length to the vicinity of a juncture between the third and fourth quarters of the length of the respective channel.

2. A combination as defined in claim 1, said channel-forming means including a divider wall between said channels and said divider wall including guide faces in the region adjacent the gravity-discharging means for guiding discharged toner to only that portion of the respective channel which is provided with said guide surfaces.

3. A combination as defined in claim 1, said channels each having an inlet and an outlet, and a cross-section which diverges in direction from said inlet to said outlet.

4. A combination as defined in claim 3, wherein said cross-section of the respective channel diverges continuously towards the respective outlet.

5. A combination as defined in claim 1; and further comprising means for transporting toner to said gravity-discharging means.

6. A combination as defined in claim 5, said transporting means including an elongated helical spring mounted for rotation about its longitudinal axis and having an open end proximal to said gravity-discharging means; further comprising an abutment; said open end pressing against said abutment with the biasing force of said helical spring.

7. A combination as defined in claim 6, said helical spring having a plurality of convolutions the pitch angle of which increases with increasing proximity of the convolutions to said open end.

8. A combination as defined in claim 6, said transporting means including a feed tube surrounding said helical spring and having an end remote from said open end; and means for connecting to said end of said feed tube a toner supply bottle so that the elongation of said bottle is substantially normal to the axis of rotation of said helical spring, said tube being turnable with a thereto connected bottle through about 180° about said axis of rotation.

* * * * *